US012644277B2

(12) United States Patent
Imfeld et al.

(10) Patent No.: US 12,644,277 B2
(45) Date of Patent: Jun. 2, 2026

(54) ROOF CONSTRUCTION

(71) Applicant: STOBAG AG, Muri (CH)

(72) Inventors: Jost Imfeld, Scherz (CH); Raphael Flaig, Muri (CH); Victor Stenz, Oberruetti (CH)

(73) Assignee: Stobag AG, Muri (CH)

( * ) Notice: Subject to any disclaimer, the term of this patent is extended or adjusted under 35 U.S.C. 154(b) by 179 days.

(21) Appl. No.: 18/386,932

(22) Filed: Nov. 3, 2023

(65) Prior Publication Data

US 2024/0060299 A1 Feb. 22, 2024

Related U.S. Application Data

(63) Continuation of application No. PCT/EP2022/061784, filed on May 3, 2022.

(30) Foreign Application Priority Data

May 3, 2021 (DE) ..... 10 2021 111 373.3

(51) Int. Cl.
*E04B 7/16* (2006.01)
*E04B 1/70* (2006.01)
*E04B 7/02* (2006.01)

(52) U.S. Cl.
CPC ..... *E04B 7/022* (2013.01); *E04B 1/70* (2013.01)

(58) Field of Classification Search
CPC . E04B 1/70; E04B 7/022; E04B 7/163; E04B 9/02; E04B 9/023; E04B 9/0407;
(Continued)

(56) References Cited

U.S. PATENT DOCUMENTS 2,825,100 A * 3/1958 Howard ..... E04F 10/08 52/78
3,113,434 A * 12/1963 Phillips ..... E04F 10/08 52/95

(Continued)

FOREIGN PATENT DOCUMENTS

DE 35488 C 10/1885
DE 102019108036 A1 10/2020

(Continued)

OTHER PUBLICATIONS

International Search Report dated Jul. 25, 2022 in corresponding application PCT/EP2022/061784.

*Primary Examiner* — Kyle J. Walraed-Sullivan
(74) *Attorney, Agent, or Firm* — Muncy, Geissler, Olds & Lowe, P.C.

(57) ABSTRACT

A roof structure has a level support frame extending in a support frame plane, is supported by a support structure and has at least two longitudinal beams arranged parallel and at a mutual distance from each other and at least two cross beams arranged parallel to each other and at a mutual distance from each other and surrounds a frame field. Several rafters connect the cross beams with each other and are arranged at a mutual distance from the longitudinal beams in such a way that the frame field is divided into several roof fields. The roof fields are each covered by a level cover plate, wherein each cover plate extends in its own cover plane and the cover planes are arranged at an angle to the support frame plane. The cover plates are each rectangular and have a long longitudinal axis and a short longitudinal axis perpendicular to it.

3 Claims, 5 Drawing Sheets

(58) Field of Classification Search
CPC ..... E04B 9/0421; E04B 9/0428; E04B 9/24; E04B 9/28
See application file for complete search history.

(56) References Cited

U.S. PATENT DOCUMENTS 4,411,109 A * 10/1983 Struben ..... E04D 13/064 52/75
4,541,214 A * 9/1985 Lambert ..... E04F 10/08 D25/48.8
5,732,507 A * 3/1998 Edwards ..... E06B 7/086 49/82.1
5,873,202 A * 2/1999 Parks ..... E04B 7/163 49/77.1
7,174,676 B1 * 2/2007 Armstrong ..... E04D 13/076 52/12
11,812,710 B2 * 11/2023 Yehia ..... A01G 7/04
2006/0000178 A1 * 1/2006 Almy ..... E04D 1/29 52/543
2008/0315061 A1 * 12/2008 Fath ..... F24S 25/634 248/510
2010/0263660 A1 10/2010 Thorne
2010/0320343 A1 * 12/2010 Beck ..... F24S 25/16 29/428
2011/0154750 A1 * 6/2011 Welter ..... F24S 25/20 52/173.3
2011/0239546 A1 * 10/2011 Tsuzuki ..... F24S 25/20 52/173.3
2011/0302857 A1 * 12/2011 McClellan ..... F24S 40/44 52/173.3
2012/0016815 A1 * 1/2012 DeBartolo, III ..... F24S 25/00 52/173.3
2014/0366466 A1 * 12/2014 DeBartolo, III ..... E04F 10/08 52/173.3
2018/0041159 A1 * 2/2018 DeBartolo, III ..... F24S 25/13
2019/0338528 A1 * 11/2019 Torman ..... E04F 10/10
2023/0151614 A1 * 5/2023 De Frene ..... E04C 3/07 52/27
2024/0141650 A1 * 5/2024 Abeel ..... E04F 10/0607

FOREIGN PATENT DOCUMENTS

EP 0612895 A1 8/1994
EP 3444412 A1 * 2/2019 ..... E04F 10/10
FR 1276335 A 11/1961
FR 3051208 A1 * 11/2017 ..... E04D 3/08
FR 3087969 A1 * 5/2020 ..... F24S 25/636
GB 2231892 A * 11/1990 ..... E04D 3/38
JP 2006249677 A 9/2006

* cited by examiner

ROOF CONSTRUCTION

This nonprovisional application is a continuation of International Application No. PCT/EP2022/061784, which was filed on May 3, 2022, and which claims priority to German Patent Application No. 10 2021 111 373.3, which was filed in Germany on May 3, 2021, and which are both herein incorporated by reference.

BACKGROUND OF THE INVENTION

Field of the Invention

The invention relates to a roof structure with a level support frame, which extends on a support frame plane, is supported by means of a support structure and comprises at least two longitudinal beams arranged parallel to each other and at a mutual distance from each other, and at least two cross beams arranged parallel to each other and at a mutual distance from each other, and which surrounds a frame field, and with at least one rafter connecting the cross beams which extends at a mutual distance to the longitudinal beams and divides the frame field into several roof fields, wherein at least some of the roof fields are covered by a level cover plate, wherein the cover plates each extend in a cover plane and wherein the cover planes are arranged at an angle to the support frame plane and wherein the cover plates are rectangular and comprise a long longitudinal axis and a short longitudinal axis perpendicular to it.

Description of the Background Art

A roof structure can be, for example, the roof of a conservatory, a building expansion or a gazebo. The level support frame is preferably rectangular and is formed of two longitudinal beams running parallel to each other and at a mutual distance to each other as well as two cross beams running parallel to each other and at a mutual distance to each other. In order to support the support frame, a support structure is provided which includes columns and/or building parts or other support elements to which the support frame is attached and which allow for the load on the support frame to be safely dissipated.

Inside the support frame, a frame field bordered by the longitudinal beams and the cross beams is formed, which is divided into several roof fields by means of at least one rafter connecting the cross beams with each other. Each roof field is protected by means of a level cover plate, particularly made of glass, wood, metal or plastic, so that objects or persons below the support frame are protected against rain.

When it rains, the rain falls from above onto the cover plates and must be drained from them. For this purpose, it is necessary to arrange the support frame and thus also the cover plates at an angle relative to a horizontal so that the water can flow off the top of the cover plates.

For aesthetic reasons, it is often desired that the support frame be arranged horizontally in order to give the roof structure a cuboid or cubic appearance. In this case, in order to be able to drain the rainwater hitting the tops of the cover plates, it is known to tilt the cover plates relative to the horizontally oriented support frame. A corresponding design is shown in JP 2006-249677 A. The roof fields formed there by means of the rafters are each covered by a level cover plate, wherein all the cover plates run parallel to each other and are inclined relative to the level support frame. If the cover plates are relatively long in the inclined direction, the disadvantage is that the difference in height between the upper side edge of the cover plate and the lower side edge of the cover plate is relatively large, so that the cover plates are exposed at the top side and/or the bottom side of the support frame or that the support frame needs to be at a higher overall height to accommodate the inclined cover plates in its inner frame area without them being exposed.

SUMMARY OF THE INVENTION

It is therefore an object of the invention to provide a roof structure in which, despite inclining the cover plates relative to the level support frame, only a small overall height of the support frame is required.

In an example of the roof structure according to the invention, a level and preferably horizontally oriented support frame can also be provided, which extends in a support frame plane and is supported by means of a support structure, e.g., by vertical columns and/or building parts on the ground, directly or indirectly. The support frame can be rectangular and can have at least two longitudinal beams arranged substantially parallel to each other at mutual distances and at least two cross beams arranged substantially parallel to each other at mutual distances. The longitudinal beams and cross beams surround a so-called frame field, which is located inside the support frame.

At least one rafter can be provided, which extends substantially parallel to the longitudinal beams and at a mutual distance from them and connects the cross beams with each other. Preferably, several rafters (ideally 3 to 5 rafters) are arranged parallel to each other at a mutual distance. The rafter(s) divide the frame field into several roof fields. At least some of the roof fields and preferably all roof fields are each covered by means of a level cover plate, ideally made of glass. Each cover plate extends in its own cover plane, wherein the cover planes preferably do not coincide but are arranged at an angle to the support frame plane. The cover planes of adjacent cover plates have a mutual distance perpendicular to these cover planes, with at least some and preferably all of the cover plates running parallel to each other. Thus, the cover plates also run parallel to each other, but at a mutual distance from each other.

It is provided that the cover plates are each rectangular and have a long longitudinal axis and a short longitudinal axis perpendicular to it. The cover plates are arranged at an angle around their long longitudinal axis relative to a horizontal. In this case, the long longitudinal axes of the cover plates, in particular, can lie horizontally and extend in the support frame plane or parallel to it. The short longitudinal axes of the cover plates are arranged at an angle opposite the horizontal and/or relative to the support frame plane.

Due to the above-mentioned arrangement of the cover plates, the frame field can be covered by several cover plates, all of which are inclined at an angle relative to the support frame but are arranged in different cover planes, which extend preferably parallel to each other. In this way, it is achieved that the overall height of the support frame can be kept low, even if the dimensions of the support frame are relatively large in the support frame plane.

The angles of inclination relative to the support frame plane of at least some cover plates and in particular of all cover plates can be equal, wherein the angle of inclination is preferably in the range of 1° to 30° and in particular in the range of 3° to 10°. The angles of inclination of adjacent cover plates may also be different, wherein all angles of inclination are preferably in the above mentioned areas.

The cover plates can each have a first long side edge, a second long side edge, and two short side edges, with the two long side edges and the two short side edges together forming the circumference of the cover plate. The cover plates can be fixed so as to be immovable to the roof structure and supported, in particular, with their first long side edge and their second long side edge, in a line bearing. The line bearing may be formed by a support or support surface extending over a section or the entire length of the respective side edge, but it is also possible for the line bearing to be formed by several individual supports arranged in a row and at mutual distances, which together form the line bearing.

The line bearings can be formed on the longitudinal beams and/or on the rafters. In particular, it may be provided that the outer cover plates are supported on one of the longitudinal beams with one of their side edges and with their opposite, other long side edge on a rafter, and that the cover plates covering an inner roof field are supported on a rafter with their first long side edge as well as with their second long side edge.

The first long side edge can be arranged at a lower elevation than the second long side edge.

The rafter can also be used to support at least one cover plate and, in particular, at least two cover plates. It may be provided that adjacent cover plates are supported on a common rafter with their sides facing each other or side edges.

For example, the rafter can have a first line bearing with a first support surface to support the first long side edge of one of the cover plates and a second line bearing with a second support surface to support the second long side edge of another cover plate. In this case, the first support surface is preferably arranged at a lower elevation than the second support surface, i.e., the second support surface is located vertically above the first support surface. The second support surface can be immediately above the first support surface. Preferably, however, the second support surface is arranged laterally offset above the first support surface.

The first long side edges of several or all cover plates can lie in a first common plane, which extends preferably horizontally.

Alternatively or in addition to this, it may be provided that the second long side edges of several or all of the cover plates are located in a second common plane, which extends preferably horizontally.

The support frame encloses the frame field, i.e., the inner area of the support frame, in the manned mentioned. Since the support frame also has a vertical height, a frame area is defined in the inner area of the support frame which is created by the frame field and the overall height of the support frame. It is preferably provided that the rafters and/or the cover plates are completely arranged within the frame area, i.e., neither protrude from the support frame on its top side nor its bottom side.

A water channel can be formed in the rafter, which serves to receive and drain the water that occurs, for example, as a result of rain on top of the cover plates.

The water channel can run in the longitudinal direction of the rafter and ends in a water outlet where the water leaves the water channel and is drained off in a continuing pipe. In particular, the water outlet is formed in the axial end area of the rafter and particularly preferably on the axial front side of the rafter.

The water channel can be designed as a gravity channel in which the water flows solely as a result of gravitational force. In particular, the water channel is to be regarded as a channel that is open at the top, in particular U- or V-shaped.

The first support surface in the upper area or above the water channel can be arranged in such a way that a fluid, in particular water, which is on the upper side of the cover plate supported on the first support surface, flows into the water channel from above and is introduced as a result of the inclination of the cover plate. The water then streams along the water channel and is discharged through the water outlet and the continuing pipe.

In the flow path from the top of the cover plate to the water channel, a filtration device may be provided, through which the water flows before the water enters the water channel. This prevents foreign bodies from entering the water channel and possibly clogging it.

A sieve or a perforated sheet can be used as a filtration device. Preferably, it is provided that a bristle strip is arranged, which can be formed by a strip-shaped arrangement of bristles and/or bristle bundles. The filtration device, and in particular the bristle strip can end just above the surface of the cover plate and thus not come in contact with it; alternatively, in a further development of the invention, the bristle strip can also be used as a hold-down device, which clamps the cover plate against the first support surface.

The second support surface for the additional cover plate can be formed on the top of the rafter. Preferably, however, it is provided that in the rafters, in particular in an offset to the top of the rafter, a gradation or a chamber-like lateral recess is provided in which the second support surface is formed.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
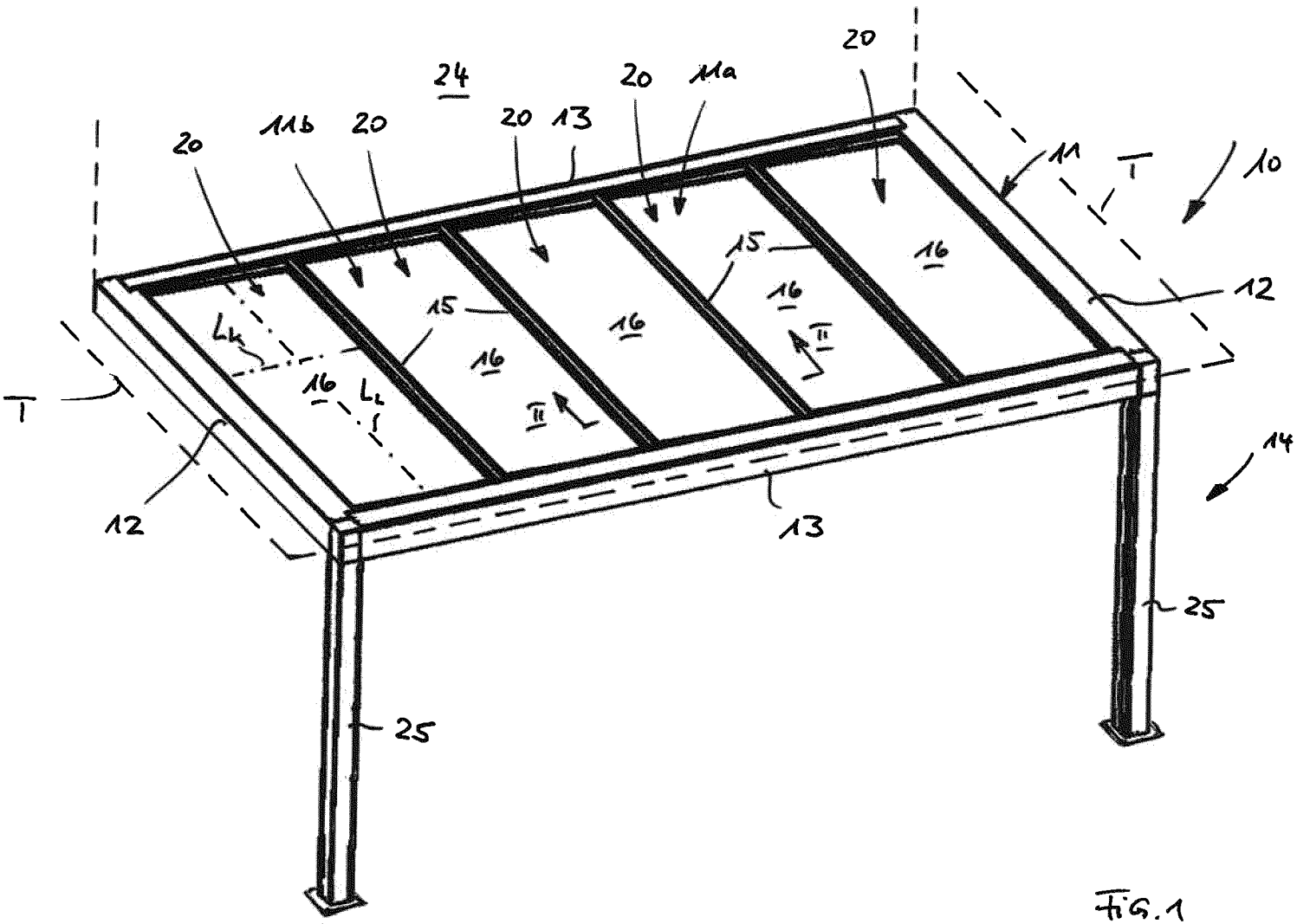
FIG. 1 shows a schematic perspective view of an inventive roof structure.

A roof structure 10 shown in FIG. 1 has a level, horizontally oriented support frame 11, which has a rectangular configuration and two longitudinal beams 12 arranged parallel to each other and at mutual distances and two cross beams 13 arranged parallel to each other and at mutual distances. The support frame 11 extends in a horizontal support frame plane T, which is only schematically depicted.

The support frame 11 is supported by means of a support structure 14, which in the embodiment shown includes two vertical supports 25 arranged in two corners of the support frame 12 and a building wall 24 that is only schematically indicated.

The longitudinal beams 12 and the cross beams 13 surround a frame field 11*a* located within the support frame 11, which is divided into several roof fields 20 by means of several rafters 15. In the embodiment shown, there are four rafters 15, which divide the frame field 11*a* into five rectangular roof fields 20 of preferably about the same size.

The roof fields 20 are each completely covered by means of a level cover plate 16, which can be made of glass. Each cover plate 16 extends in its own cover plane $A_1$, $A_2$, $A_3$ (see FIGS. 2 and 4), with the cover planes $A_1$, $A_2$, $A_3$ extending inclined at an angle $\alpha$ to the support frame plane T and parallel to each other. Adjacent cover planes $A_1$, $A_2$ or $A_2$, $A_3$ of adjacent cover plates 16 extend at a mutual distance perpendicular to the cover planes.

Figure 3:
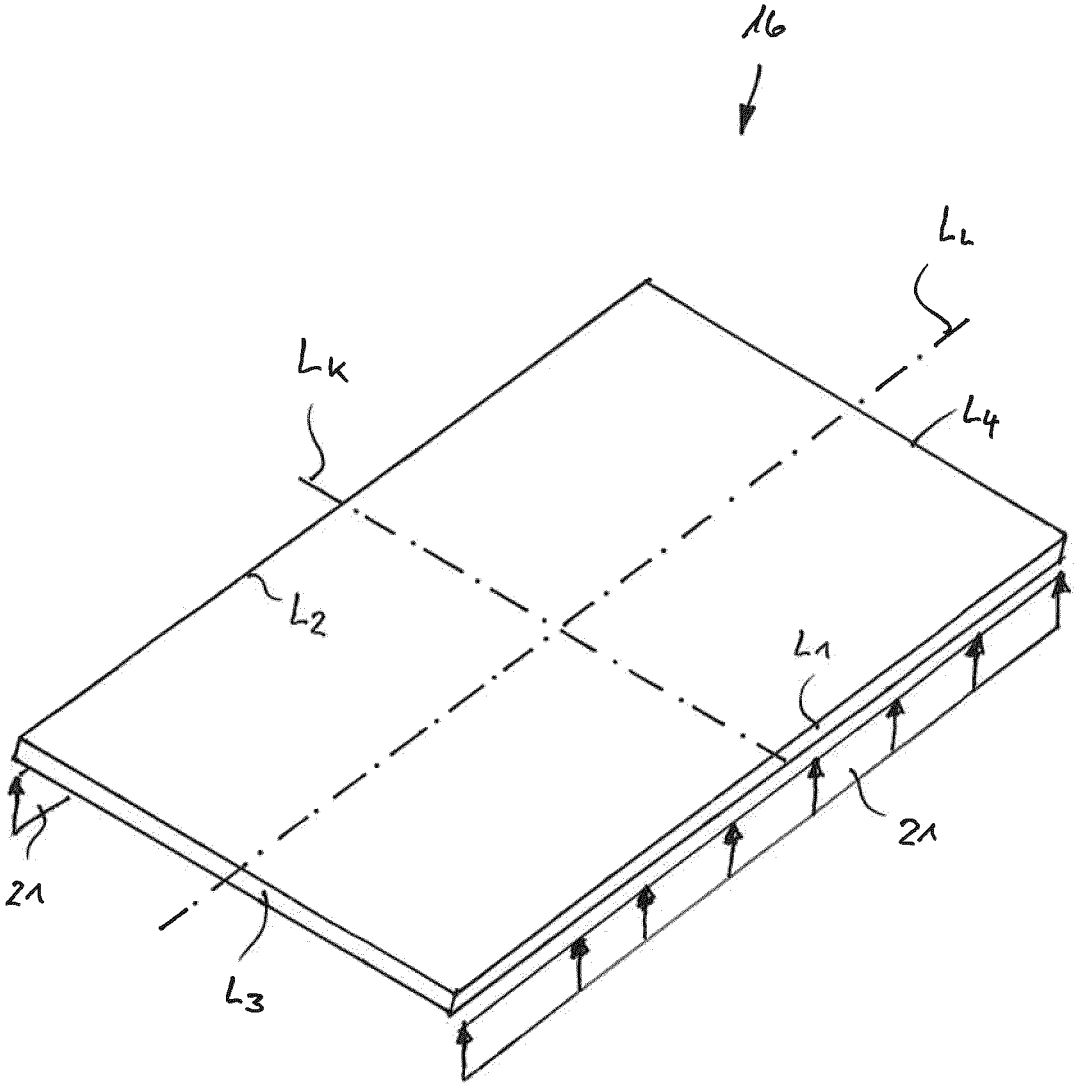
FIG. 3 shows a perspective view of a cover plate.

FIG. 3 shows a single rectangular cover plate 16. The cover plate 16 has a long longitudinal axis $L_L$ and a perpendicular short longitudinal axis $L_K$, wherein the cover plate 16 is arranged at an angle around the long longitudinal axis $L_L$ relative to a horizontal. In the embodiment shown, the short longitudinal axis $L_K$ of the cover plates 16 is parallel to the building wall 24, wherein the cover plates 16 are inclined around the long longitudinal axis $L_L$, which runs perpendicular to the building wall 24.

The cover plate 16 has a first long side edge $L_1$ and on the opposite side a second long side edge $L_2$, as well as two short side edges $L_3$ and $L_4$ perpendicular thereto. The first long side edge $L_1$, the second long side edge $L_2$, and the two short side edges $L_3$ and $L_4$ form the circumferential area of the cover plate 16. As indicated in FIG. 3, the cover plate with its first long side edge $L_1$ and with its second long side edge $L_2$ is in each case supported in a line bearing 21, the constructive design of which will be explained later.

Figure 4:
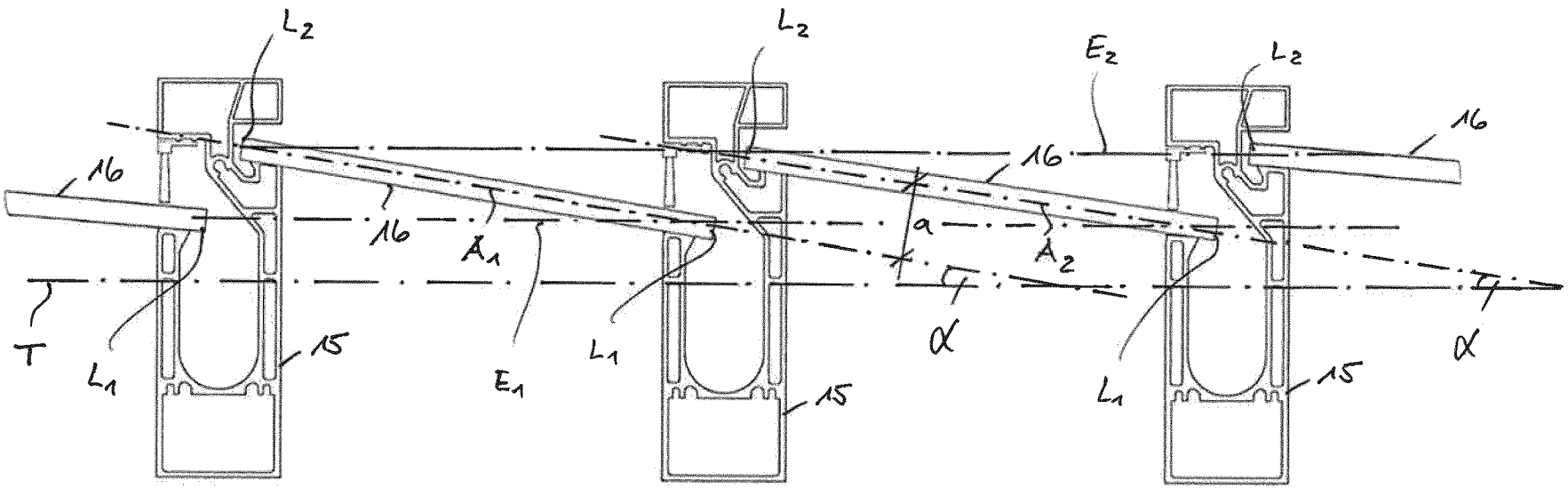
FIG. 4 shows a representation of the course of the support frame plane and the cover planes.

It can be seen from FIG. 4 that the first long side edges $L_1$ of several or all cover plates 16 lie in a common first plane $E_1$, the first plane $E_1$ extending horizontally.

The second long side edges $L_2$ of several or all cover plates 16 are also located in a second common plane $E_2$, which also extends horizontally.

The support frame 11 encloses the frame field 11*a* in the mentioned manner and thus the inner surface of the support frame 11. Inside the support frame 11, a frame area 11*b* is defined, which includes the frame field 11*a* and the overall height of the support frame 11. The rafters 15 and the cover plates 16 are arranged entirely within the frame area 11*b* and do not protrude over the top nor the bottom of the support frame 11.

Figure 5:
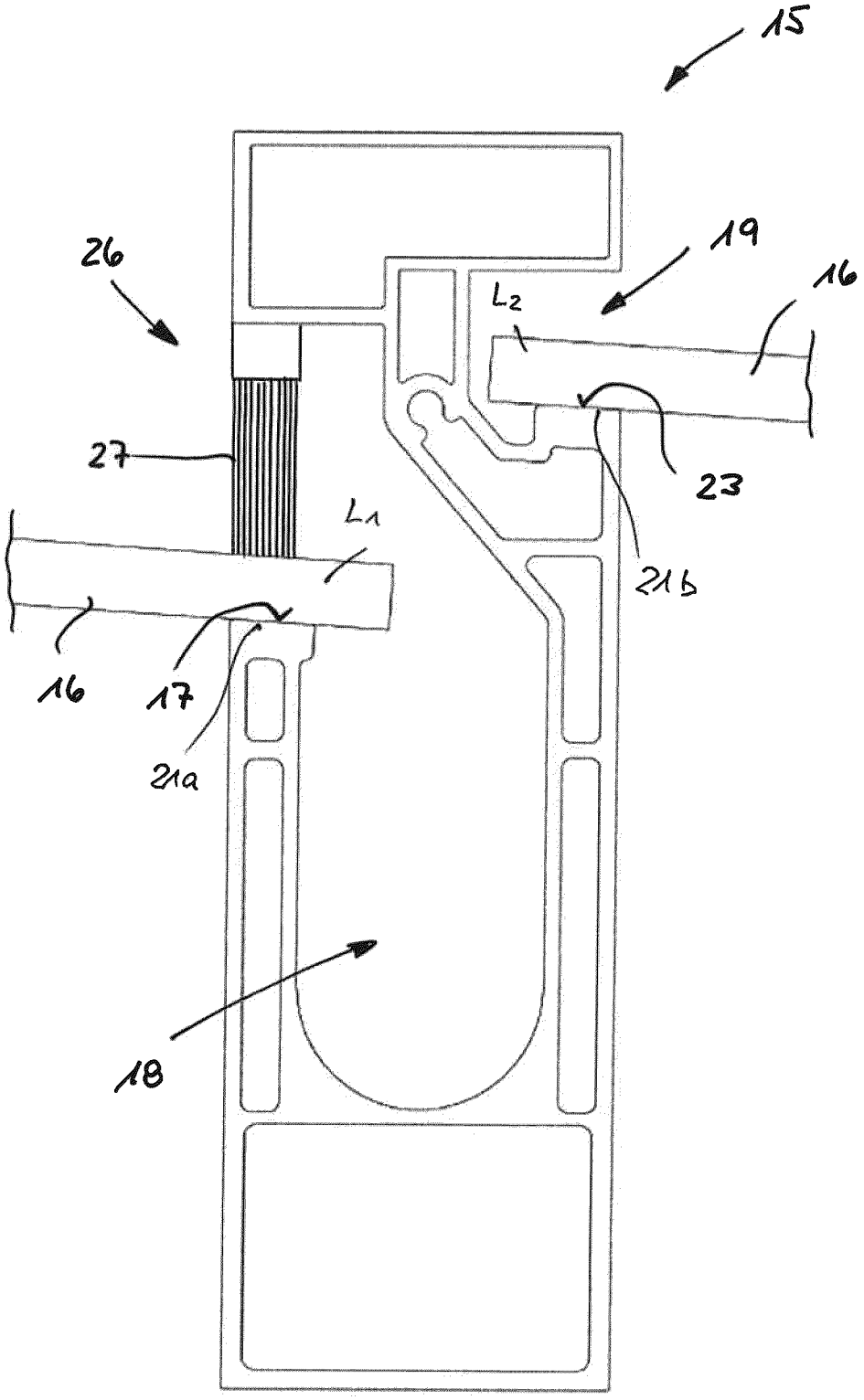
FIG. 5 shows section v-v in FIG. 2.

Adjacent cover plates 16 are each mounted with one end to the one of the rafters 15, as can be seen in particular from FIG. 5. The rafter 15 has a first line bearing 21*a* with a first support surface 17 on which the first long side edge $L_1$ of one of the cover plates 16 is supported. Furthermore, the rafter has a second line bearing 21*b* with a second support surface 23, on which the second long side edge $L_2$ of another cover plate 16 is supported.

Figure 2:
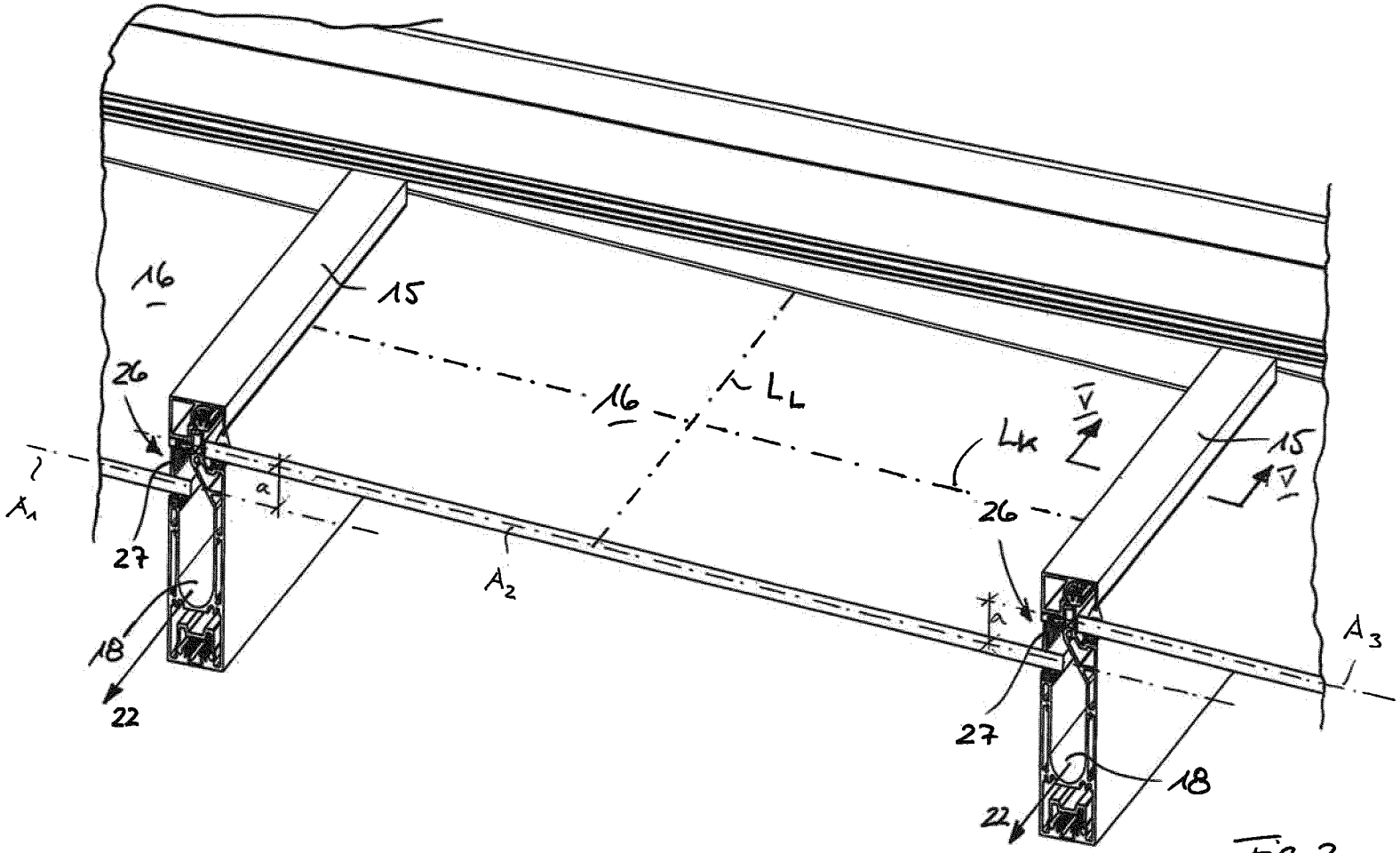
FIG. 2 shows section II-II in FIG. 1.

In the rafter 15 a water channel 18 is formed, which is designed as a U-shaped channel which is open at the top and runs in the longitudinal direction of the rafter 15 and at the axial end of which ends in a water outlet 22, which is shown in FIG. 2 as indicated by an arrow. The first support surface 17 is arranged in the upper part of the water channel 18 in such a way that the rainwater that accumulates on top of the cover plate 16, which is supported on the first line bearing 21*a* or on the first support surface 17, flows or drips into the water channel 18 from above as a result of the inclination of the cover plate 16. The water is then diverted in the water channel 18 and discharged through the water outlet 22.

In the flow path from the top of cover plate 16 to the water channel 18, a filtration device 26 is provided through which the water flows before the water enters the water channel 18. This prevents foreign bodies from entering into the water channel 18 and clogging it.

The filtration device 26 is provided for a bristle strip 27 formed by an elongated arrangement of bristles and/or bristle bundles and is attached to the rafter 15 above the cover plate 16 in such a way that the bristles and/or bristle bundles sit with their ends from above on the top of the cover plate 16. The filtration device 26 or the bristle strip 27 can also serve as a hold-down device that clamps the cover plate 16 against the first support surface 17.

Obliquely above the first support surface 17, a chamber-like recess 19 is formed in the rafter 15, on the bottom of which the second support surface 23 is formed. The other cover plate 16 is inserted with its end area in the recess 19 and mounted on the second support surface (23).

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A roof structure comprising:

a level support frame that extends in a support frame plane and is supported by a support structure and comprises at least two longitudinal beams arranged substantially parallel to each other and at mutual distances and two cross beams arranged substantially parallel to each other and at mutual distances, and which surrounds a frame field;

at least one rafter connecting the two cross beams to each other and running at a mutual distance to the two longitudinal beams and dividing the frame field into several roof fields, wherein at least some of the roof fields are each covered by a cover plate, such that a plurality of cover plates are provided, wherein the cover plates each extend in a respective cover plane with the cover planes being arranged at an angle to the support frame plane, wherein the cover plates are each rectangular having a length and a width with the length being longer than the width, and the cover plates each have a first longitudinal axis and a second longitudinal axis running substantially perpendicular to each other, the first longitudinal axis corresponding to the length and the second longitudinal axis corresponding to the width, wherein the cover plates are arranged at an angle around the first longitudinal axis relative to a horizontal, wherein the cover planes of adjacent cover plates have a mutual distance from each other substantially perpendicular to the cover planes, wherein the support frame surrounds a frame area defined within the support frame, wherein the at least one rafter and/or the cover plates are arranged completely within the frame area, wherein the cover plates each have a first side edge, a second side edge that is parallel to the first side edge, a third side edge and a fourth side edge that is parallel to the third side edge, wherein the third and fourth side edges are shorter than the first and second side edges, wherein the first side edge is supported in a first line bearing and the second side edge is supported in a second line bearing, wherein the at least one rafter comprises the first line bearing with a first support surface to support the first side edge of a first one of the cover plates and the at least one rafter comprises the second line bearing with a second support surface to support the second side edge of a second one of the cover plates, wherein the first support surface is arranged at a lower elevation than the second support surface, wherein a water channel is formed in the at least one rafter, wherein the first support surface is provided in an upper part of the water channel, such that a fluid which is located on a top of the first one of the cover plates that is supported on the first support surface is introduced into the water channel from above, and wherein a filtration device is arranged in the upper part of the water channel, such that the fluid located on the top of the first one of the cover plates flows through the filtration device and then into the water channel.

2. The roof structure according to claim 1, wherein the filtration device comprises a bristle strip.

3. The roof structure according to claim 1, wherein the filtration device serves as a hold-down device which clamps the first one of the cover plates against the first support surface.

* * * * *